US008722413B1

(12) United States Patent
Gracia et al.

(10) Patent No.: US 8,722,413 B1
(45) Date of Patent: May 13, 2014

(54) BIODIESEL AUTOMATIC TITRATION SYSTEM

(76) Inventors: Jimmy Gracia, Elmont, NY (US); Anthony Troy Hardtke, Ottawa (CA); Eric Tallent, Garland, TX (US)

( * ) Notice: Subject to any disclaimer, the term of this patent is extended or adjusted under 35 U.S.C. 154(b) by 212 days.

(21) Appl. No.: 13/214,923

(22) Filed: Aug. 22, 2011

Related U.S. Application Data

(60) Provisional application No. 61/376,061, filed on Aug. 23, 2010.

(51) Int. Cl.
*C11B 3/00* (2006.01)
*C11B 3/02* (2006.01)

(52) U.S. Cl.
USPC ..... 436/51; 204/194; 204/400; 210/198.1

(58) Field of Classification Search
USPC ..... 436/51; 204/194, 400; 210/198.1
See application file for complete search history.

(56) References Cited

U.S. PATENT DOCUMENTS

| | | | | |
|---|---|---|---|---|
| 7,414,255 | B1 * | 8/2008 | Amend et al. | 250/573 |
| 2005/0006290 | A1 * | 1/2005 | Patten | 210/198.1 |
| 2006/0016701 | A1 * | 1/2006 | Qin et al. | 205/792 |

* cited by examiner

*Primary Examiner* — Krishnan S Menon
*Assistant Examiner* — Rebecca M Fritchman
(74) *Attorney, Agent, or Firm* — Luis Figarella

(57) ABSTRACT

An automated system and process for the titration of either Waste vegetable oil (WVO) or virgin vegetable oil during its chemical conversion into Biodiesel. A system capable of automatically measuring and controlling the addition of a suitable amount of titration fluid is controlled in reaction to a pH level measurement tool, as determined by sensors and software. The process comprises forming a single phase solution of WVO and titrant in a ratio of between 10:1 to 50:1.

1 Claim, 6 Drawing Sheets

BIODIESEL AUTOMATIC TITRATION SYSTEM

CROSS-REFERENCE TO RELATED APPLICATIONS

This application claims priority to U.S. provisional patent application Ser. No. 61/376,061 titled "Biodiesel Automatic Titration System" filed on Aug. 23, 2010, the disclosure of which is incorporated herein by reference in its entirety.

PATENTS CITED

The following documents and references are incorporated by reference in their entirety, Boocock (U.S. Pat. No. 6,712,867), Patten (U.S. Pat. Appl. US20050006290) and John et al (U.S. Pat. Appl. US20070240362).

FIELD OF THE INVENTION

The present invention generally relates to Biodiesel titration systems and in particular to an automated titration system.

DESCRIPTION OF THE RELATED ART

Biodiesel is the name of a clean-burning alternative fuel, produced from a chemical reaction between vegetable oil and potassium methoxide. Biodiesel contains no petroleum, but it can be blended at any concentration with petroleum diesel to create a biodiesel blend. It can be used in compression-ignition (diesel) engines with little or no modifications. Biodiesel is made through a chemical process called transesterification whereby the glycerin is separated from the fat or vegetable oil. The process leaves behind two products—methyl esters (the chemical name for biodiesel) and glycerin (a valuable byproduct usually sold to be used in soaps and other cosmetic products).

Titration is a method used to determine the appropriate amount of lye (base) needed for a particular batch of vegetable oil when making diesel. Note that by these vegetable oils we refer to both waste vegetable oil (WVO) and virgin or unused oils, including the oil from both vegetables and seeds. These include olive, corn, palm, seed, flax and other similar oils. Traditionally, titration is performed manually, during a formation time that can take up to 8 hours. Biofuels are fuels derived from renewable resources such as naturally occurring fats and oils. Such fats and oils may be obtained from a variety of plant and animals. Biodiesel relates to the specific application to diesel fuel.

While there has been significant work in the area, there is a need for an automated process and system capable of automated titration of waste oils into Biodiesel.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect, the invention is about a system for the automated titration of waste vegetable oil comprising a mixing container having fluid mixing means, a computer control system capable of interfacing, actuating and controlling the various system components, a constant volume dispenser comprised of a reservoir and a drop dispenser as well as a solenoid valve capable of being opened or closed by said computer control system, a drop counter capable of counting the drops released from said drop dispenser and reporting this number to said control system and a pH probe interfaced to said control system for constant measurement of the pH level of the solution within said mixing container.

In another aspect, the drop counter constantly measures background light so as to be immune to light changes in the room. In yet another aspect, said mixing container contains used waste vegetable oil, and said constant volume dispenser contains a titrant solution.

In another aspect, the invention is about a method for the automatically titration of waste vegetable oil comprising the filling a mixing container having fluid mixing means with a given amount of waste vegetable oil, providing a computer control system capable of interfacing, actuating and controlling the various system components, filling a constant volume dispenser comprised of a reservoir and a drop dispenser as well as a solenoid valve capable of being opened or closed by said computer control system with a titration solution, providing a drop counter capable of counting the drops released from said drop dispenser and reporting this number to said control system, providing a pH probe interfaced to said control system for constant measurement of the pH level of the solution within said mixing container; and adding titrant solution until the pH level of the fluid within the mixing container is within the range of 8 to 9. In another aspect, the method comprises providing a drop counter that constantly measures background light so as to be immune to light changes in the room.

Other features and advantages of the present invention will become apparent upon examining the following detailed description of an embodiment thereof, taken in conjunction with the attached drawings.

Figure 1:
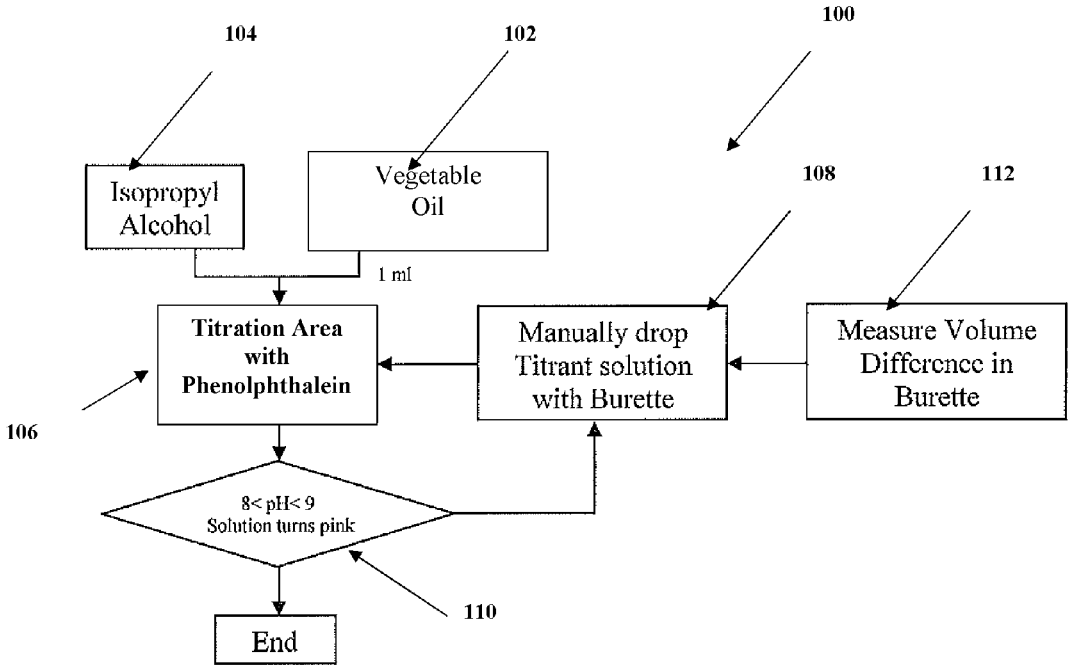
FIG. 1 shows the flow chart for the manual titration process.

The above-described and other features will be appreciated and understood by those skilled in the art from the following detailed description, drawings, and appended claims.

DETAILED DESCRIPTION OF THE PREFERRED EMBODIMENT

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Referring to FIGS. 1-5, we see a flowchart for the traditional manual Titration process 100. In order to properly determine the correct amount of reagents necessary to create biodiesel from either waste vegetable oil (WVO) or virgin or unused oils. The use of the term WVO is understood to mean both of the above. The oil must first go through a titration process. In one embodiment, the titration process consists of mixing 1 ml of vegetable oil or waste vegetable oil (WVO) 102 with 10 ml of isopropyl alcohol 104 in an appropriate mixing container 106 then manually adding the titrant or titration solution 108, (potassium hydroxide solution (KOH) or sodium hydroxide solution), to the WVO/alcohol mixture until the pH is in the 8-9 range, at which point the solution turns pink in color 110. Alternately, the pH is measured 112.

In alternate embodiments, the ratios of WVO to Alcohol may be varied (as low as 1:50 or as high as 1:5), and materials with titration properties similar to Potassium or Sodium Hydroxide may be used. Of course, manual titration can be very monotonous and time consuming as well as difficult for someone without a Chemistry background, or who is colorblind. The invention takes much manual labor and human error out of the titration process by integrating automated parts with computer hardware and software. While in one embodiment we have used certain software (LABVIEW), those skilled in the art will understand that any number of programming environments may be customized to accomplish the same goal.

Figure 2:
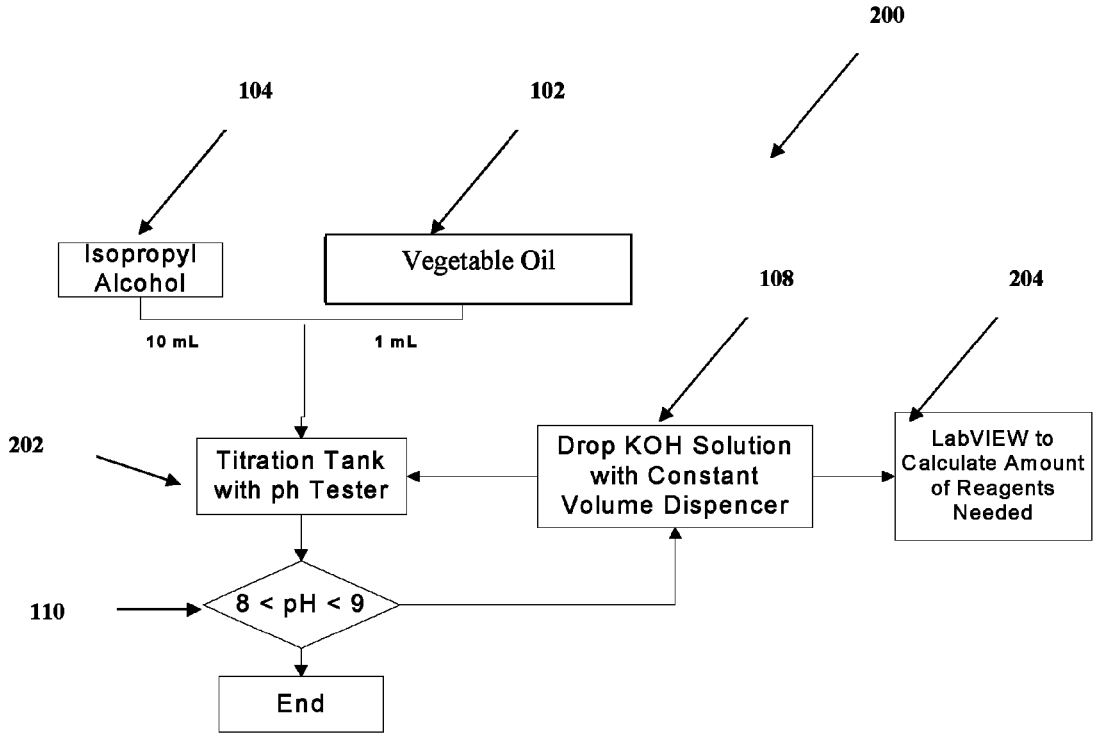
FIG. 2 shows the flow chart of the automated titration process.

Referring to FIG. 2, we see the flow chart for the automated titration process and system 200. The system communicates results during the titration process to determine whether or not more titrant solution 108 is needed to achieve its necessary basic requirements (ph levels between 8 and 9) 110. Once the system has reached the specific pH level, it shuts down. The mixing container 106 is enhanced by the addition of a pH probe 202, which provides the real-time results of the titration through a measurement process implemented into the software or program 204 within the control system, causing it to calculate the required amount of titrant for any given amount of the specific oil tested. In an alternate embodiment, the container has automated mixing means, such as paddles, beaters or such other fluid moving mechanisms that are under the electronic control of the control system 310.

In one embodiment, the control software is implemented within the LabVIEW programming environment. Alternate embodiments should be able to operate based on any number of suitable sequential decision programming environments, such as Java, C++ or others.

Figure 3:
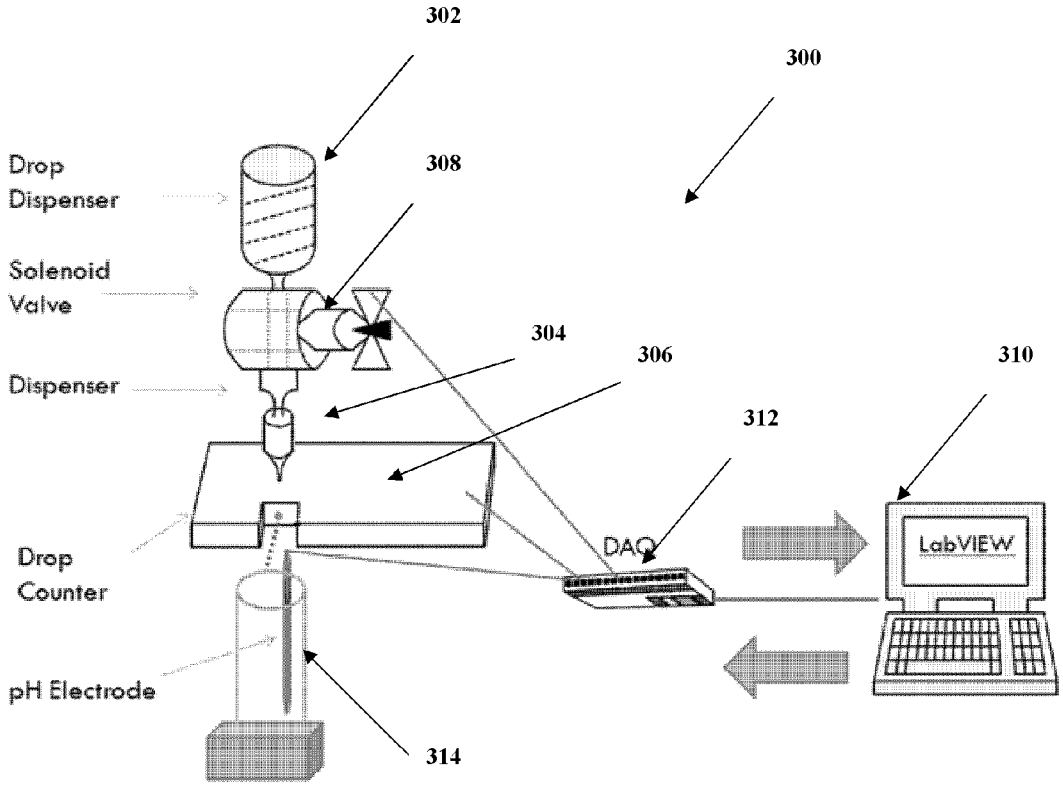
FIG. 3 shows the components of a complete automated titration system, according to an exemplary embodiment.
Figure 4:
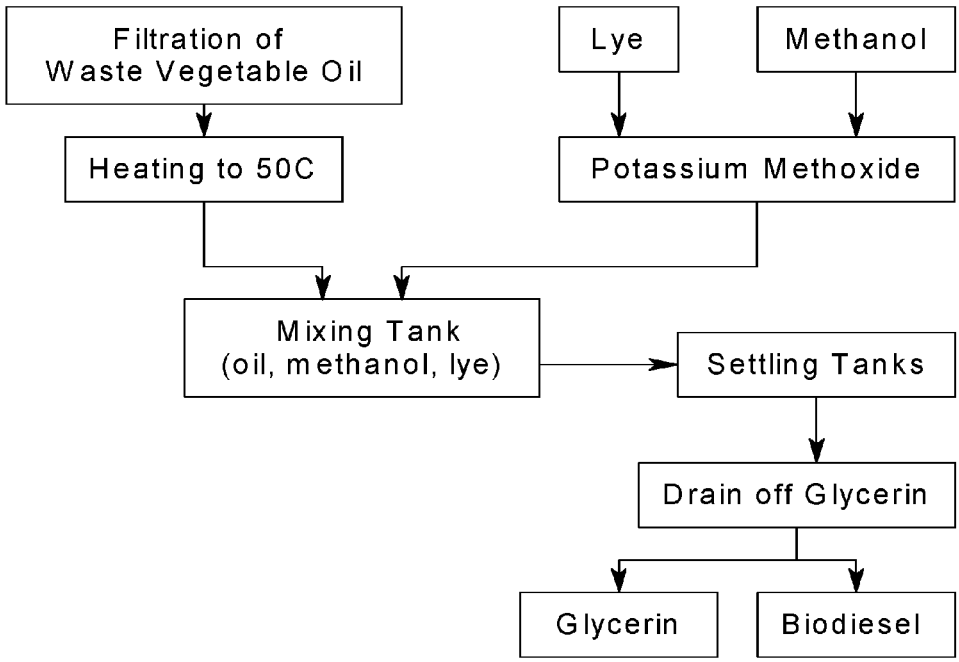
FIG. 4 shows a generic biodiesel production flowchart.
Figure 5:
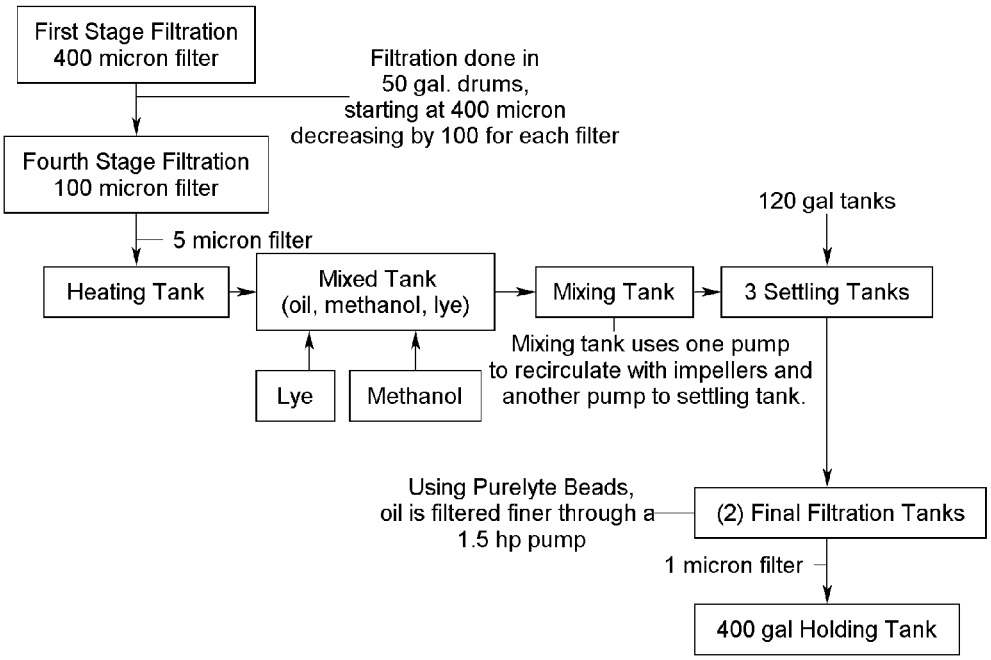
FIG. 5 shows the proposed new biodiesel production flowchart.

Referring to FIG. 3, we see an exemplary embodiment of an automated process system 300. To automate this process, several components from the manual process are replaced with components that make calculations easier and more accurate. Burettes are replaced with a constant volume dispenser comprised of a reservoir 302 and the actual dispenser or drop dispenser 304. There is also a drop counter 306. A solenoid valve 308 is attached to the constant volume dispenser so the computer can turn off the titrant solution 108 when the computer or control system 310 commands it.

The constant volume dispenser is a key component of the system. If only a solenoid valve 308 was added to the burette, then volume of each drop dispensed by the burette would be different, because of the head loss developed in the thin tube of the burette. With the constant volume dispenser, the head loss is greatly diminished and the volume of each drop is consistently the same.

The solenoid valve 308 is used to control the drop or flow rate of titrant solution from the constant volume dispenser. The valve 308 is controlled by the control system 310 computer. The valve turns on when the solution had to set for a reading and off when the fluid in the titration tank has reached a desired pH level. The solenoid is connected to the solenoid interface, actuate and control module 312. The control module is operated by the computer to open or close the valve 308.

The drop counter 306 records each drop that passes through it from the constant volume dispenser. The drop counter works by using an optical device that records when there is a significant change in light across the sensor. In one embodiment, the drop counter constantly measures background light (approximately 8000 times per second) so that it is immune to changes in surrounding light, such as the shadow of someone that is passing by.

In one embodiment, a pH probe 314 is used to constantly read the pH by reading a voltage differential within the solution. This information (proportional to the pH level) is sent via the interface/actuator unit 312 to the software being executed within the computer/control system 310. The control system is constantly running and monitoring the pH level until the desired values are reached, at which time the addition of titration solution is ended.

Figure 6:
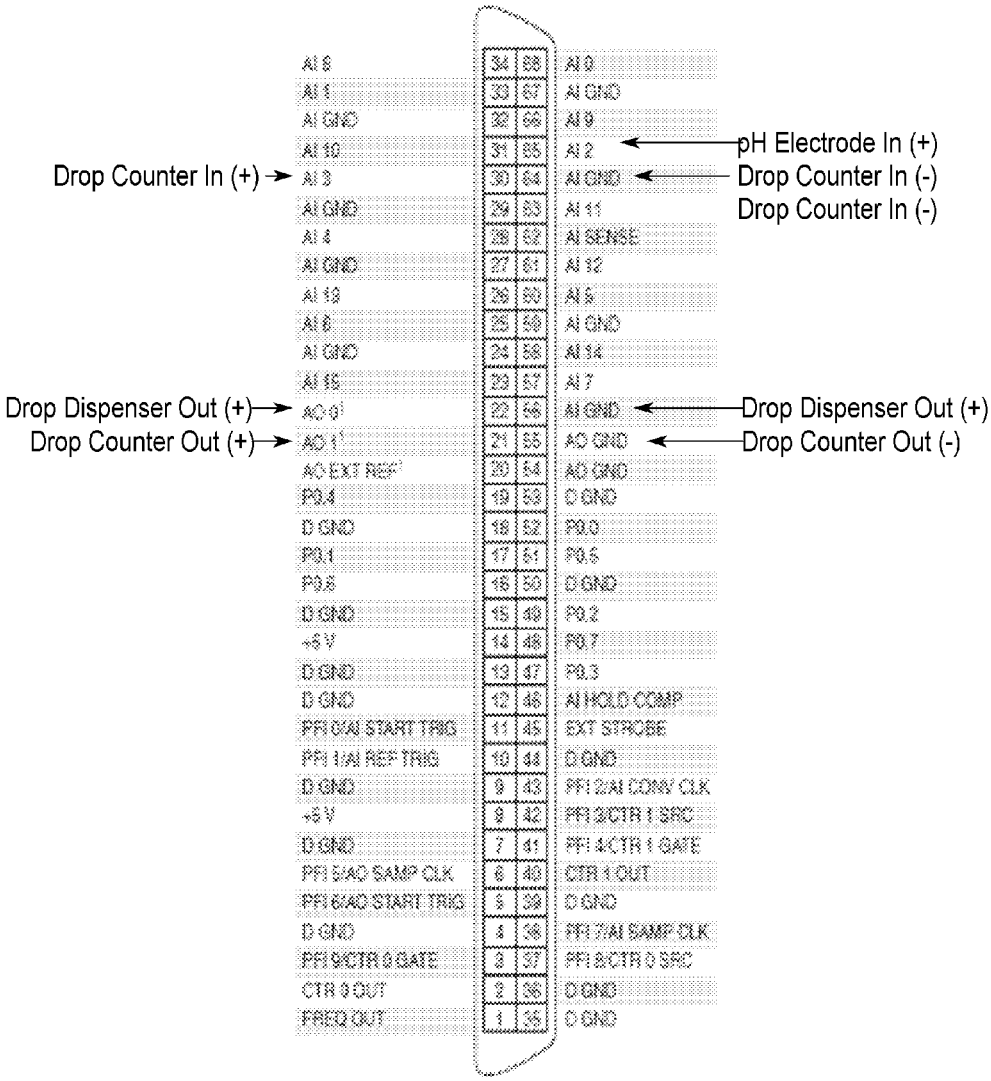
FIG. 6 shows the pin layout of the interface, actuate and control electronics.

In one embodiment, the pH probe constantly sends its voltage readings to the control system 310. When the pH electrode voltage is in a range that correlates to a pH between 8 and 9, the solenoid valve closes. The total drops are then used to calculate the total volume of titrant solution that was added to the WVO/alcohol solution. This volume is then used to calculate the amount of KOH necessary for conversion of that specific WVO for any given amount of oil. Referring to FIG. 6, it shows the pin layout of the interface, actuate and control electronics.

In one embodiment, the constant volume dispenser allows for an easy equation to determine the amount of KOH solution added to the WVO/alcohol solution. Because the volume of each drop is a constant 0.034 ml, the following equation can be used to determine the total volume, where n is the number of drops:

$$V=0.034n$$

Using the equation below, we are able to determine exactly how much titrant or KOH is necessary. With these, we, we can calculate the volume of KOH necessary to mix for any given amount of WVO.

$$[(V+3.5)\times 1.4]\frac{gKOH}{lWVO}\times LWVO = gKOH \text{ necessary}$$

In practice, it has been found necessary to condition the pH electrode by using deonized water.

Example 1

Each sample of oil will have been sufficiently filtered and accurately titrated in order to gain crucial information for proper chemical mixing of WVO, Methanol and Potassium Hydroxide (KOH) or Sodium Hydroxide (NaOH). Quality testing of each sample of biodiesel was analyzed for chemical composition and performance using a Gas Chromatography Mass Spectrometer and a diesel engine.

The WVO was first filtered through a Buchner funnel into an Erlenmeyer flask to remove any food scraps and/or solid particles. One milliliter (1 ml) of WVO was mixed with 10 ml of isopropyl alcohol along with two drops of phenolphthalein in an Erlenmeyer flask with a magnetic stirrer inside. A potassium hydroxide solution was made by mixing 1.4 g of KOH with 1 L of water in a 1 L mixing bottle. The KOH solution was added into the pipette and the initial position of the meniscus was recorded.

The Erlenmeyer flask containing the WVO and isopropyl alcohol was placed on the stirring pad and the pipette was placed over the opening of the flask. The stirring pad was turned on and the pipette was opened just enough so that the KOH solution was dripping into the flask. As soon as the color of the mixture in the flask started to turn pink, for at least 10 seconds, the pipette was closed and the final reading of the meniscus was recorded. The initial meniscus measurement was subtracted from the final measurement to obtain the required amount of KOH solution used. This amount was used to calculate the amount of lye necessary for further batches of biodiesel.

After the necessary amount of lye was calculated, it was then added to a volume of methanol equal to 20% of the volume of the WVO in a 100 ml beaker. The filtered WVO was placed in a sizeable beaker depending on the quantity of WVO, and heated to approximately 54° C. The lye and methanol mixture was added to the WVO along with a magnetic stirrer and placed on the stirring pad and allowed to mix for about an hour. After the mixing was done, the contents of the beaker were allowed to settle for several hours. The settling allows the glycerin to separate from the biodiesel.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

We claim:

1. A system for the automated titration of vegetable oil comprising;

a mixing container having fluid mixing means, said mixing means comprised of automated paddles or beaters, wherein said container contains vegetable oil;

a computer control system capable of interfacing, actuating and controlling the various system components;

a constant volume dispenser comprised of a reservoir and a drop dispenser as well as a solenoid valve capable of being opened or closed by said computer control system, wherein said dispenser contains a titrant solution;

a drop counter capable of counting the drops released from said drop dispenser and reporting this number to said control system, wherein the drop counter constantly measures background light so as to be immune to light changes in the room; and a pH probe interfaced to said control system for constant measurement of the pH level of the solution within said mixing container.

* * * * *